United States Patent [19]

Sato

[11] 4,176,603

[45] Dec. 4, 1979

[54] LABEL STRIP INSERTING DEVICE

[75] Inventor: Yo Sato, Tokyo, Japan

[73] Assignee: Kabushiki Kaisha Sato Kenkyusho, Tokyo, Japan

[21] Appl. No.: 837,193

[22] Filed: Sep. 28, 1977

[30] Foreign Application Priority Data

Oct. 22, 1976 [JP] Japan ..... 51-142079[U]

[51] Int. Cl.[2] ..... B41K 3/44; B41J 15/04; B41F 1/08

[52] U.S. Cl. ..... 101/291; 101/288; 101/228; 156/384; 226/89; 400/600.1; 400/134.5; 400/613.1

[58] Field of Search ..... 226/98; 101/288, 291, 101/292, 228, 66; 156/384; 400/600–600.4, 134.5, 613.1

[56] References Cited

U.S. PATENT DOCUMENTS

| | | | |
|---|---|---|---|
| 2,332,033 | 10/1943 | Welker | 400/600 |
| 2,425,172 | 8/1947 | Britten, Jr. | 400/600.4 |
| 2,963,138 | 12/1960 | Motle et al. | 400/600.3 |
| 3,393,847 | 7/1968 | Young et al. | 226/89 |
| 3,741,847 | 6/1973 | Sato | 156/384 |
| 3,979,036 | 9/1976 | Vorbach et al. | 226/89 |
| 4,075,944 | 2/1978 | Conley | 101/288 |

*Primary Examiner*—William Pieprz

*Attorney, Agent, or Firm*—Ostrolenk, Faber, Gerb & Soffen

[57] ABSTRACT

A label strip inserting device for use in a label printing machine; the inserting device comprises: a platen pivotally secured to the machine frame, a label guide member pivotally secured to the frame, an operating member interlocked with the platen and the guide member; rotation of the operating member moves the platen and guide member between widely spaced inoperative positions enabling insertion of a label strip and closely spaced operative positions; the operating member has a guide surface that is rotated to define part of the label strip pathway when the guide member is in its inoperative position; label guide pieces on the machine frame positioned near a label holder on the frame; the guide member aligns with the guide pieces to define an insertion pathway when the guide member is in the inoperative position.

11 Claims, 5 Drawing Figures

LABEL STRIP INSERTING DEVICE

BACKGROUND OF THE INVENTION

1. Field of the Invention

The present invention relates to a label strip inserting device for a portable label printing machine.

2. Description of the Prior Art

In a conventional label strip inserting device of a label printing machine, a label strip is inserted into the label printing machine by opening a large space for the label strip to pass between a label guide member, on one hand, and a platen and a feed wheel, on the other hand. The feed wheel has feed projections for label transferring. The label guide member is initially in contact with both the platen and the feed wheel. The guide member is separated from the platen and the feed wheel by opening a bottom cover on the labeler and lowering the platen which is connected to the cover. This creates that large space needed for insertion of a label strip. However, when the free or leading end of the label strip has been erroneously bent or folded, the inserted label strip may pass to the front portion of the machine at the printing head or to the rear portion of the machine at the rear side of the feed wheel, and reliable label strip insertion cannot always be expected.

SUMMARY OF THE INVENTION

It is, therefore, the principal object of the present invention to provide an improved label strip inserting device for use in a portable label printing machine.

It is a further object of the invention to provide such an inserting device which is free of the disadvantages of conventional inserting devices.

Another object of the present invention is to provide such a label strip inserting device for which reliable label strip insertion can be obtained.

A portable label printing machine which is provided with the label strip inserting device of the present invention includes a feed wheel that is pivotally secured to the label printing machine frames. The feed wheel transfers both the label strip and the underlying backing strip that is peeled from the label strip and is folded backward around the underside of the platen.

The label strip inserting device comprises: a platen pivotally secured to the machine frame, an operating member having a label guide surface and which is interlocked to move as the platen moves, a label guide member interlocked to move as the operating member moves, and label guide pieces which align with the guide surface of the operating member for forming a label insertion opening. During label insertion, the bottom cover of the machine body is opened, and the platen is turned down to open it. This separates the label guide member from the peripheral surface of the feed wheel. The space for inserting a new label strip is formed along the operating member and the label guide member. The label strip inserting device of the present invention permits a label strip having its free end of any shape, including curled, bent or torn off, to be easily inserted into the labeling machine without fail.

BRIEF DESCRIPTION OF THE DRAWINGS

Other objects and features of the present invention will become apparent from the following description taken in connection with the accompanying drawings, in which.

DESCRIPTION OF THE PREFERRED EMBODIMENT

Figure 1:
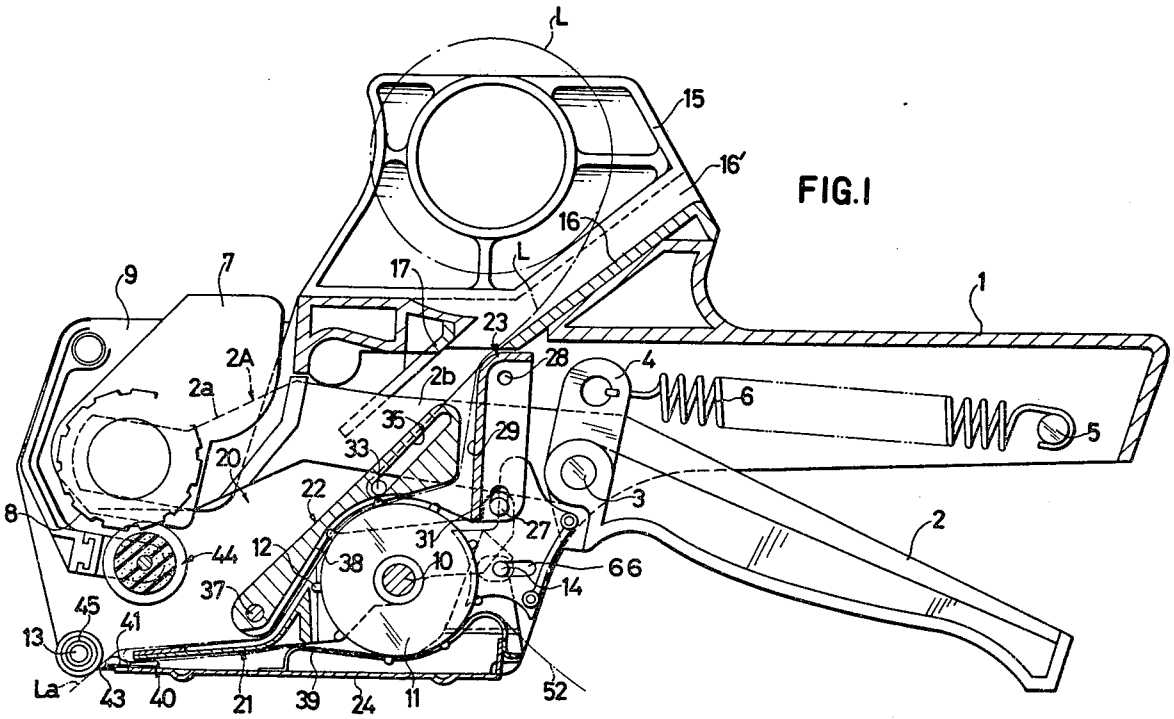
FIG. 1 is a vertical cross-sectional view through a label printing machine which is provided with the label strip inserting device of the present invention and with that device in a closed position.
Figure 2:
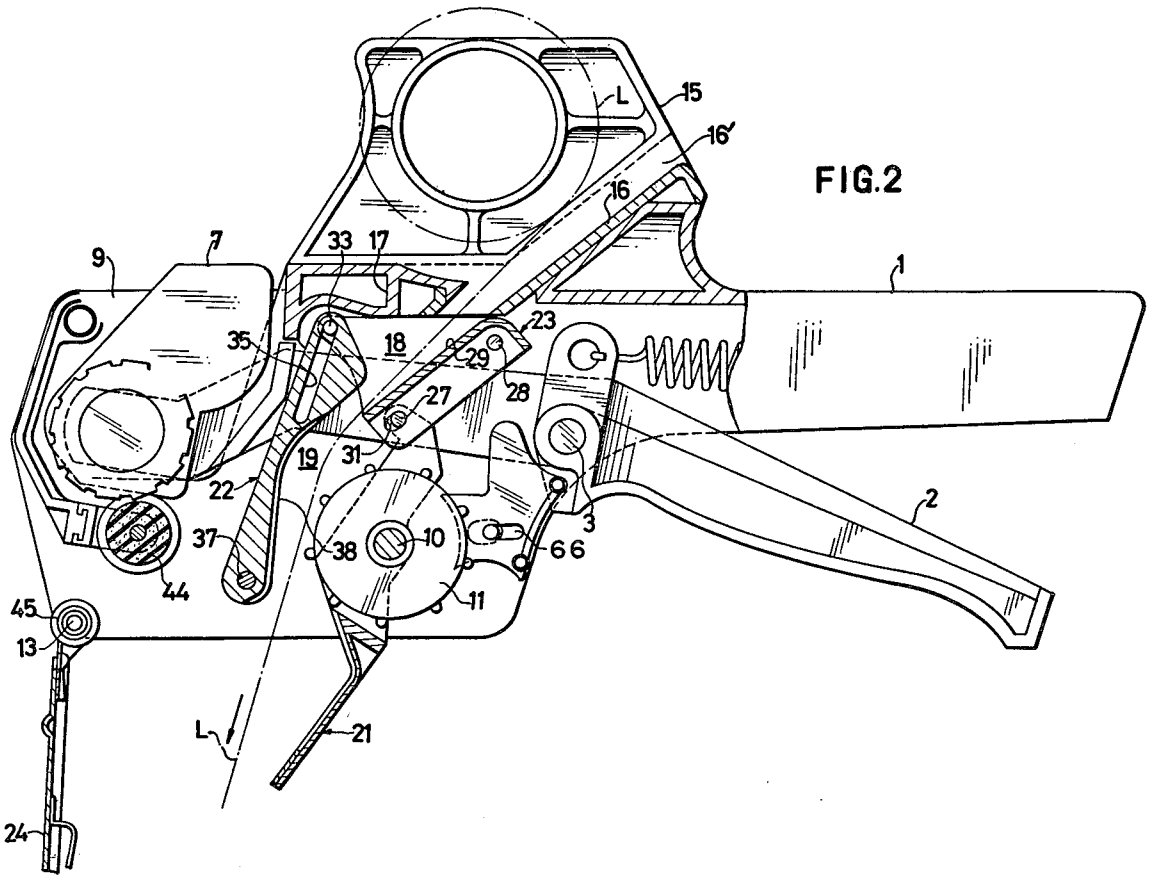
FIG. 2 is the same type of view as FIG. 1 with the insertion device in an open position for label insertion.

Referring to FIGS. 1 and 2, the portable label printing machine having an insertion device according to the invention is integrally provided with a hollow hand grip 1 at its rear portion and with a hand lever 2 that is pivotally secured to a shaft 3 that is fixedly located on the machine frames 9. A return spring 6 is stretched between the spring holding member 4 at the front part of the hand lever 2 and the spring holding member 5 on the rear part of the hand grip 1. Accordingly, the hand lever 2 is normally biased to return to the stationary position of FIG. 1 by the force of the return spring 6.

The forwardly extending portions of the hand lever 2 in front of the shaft 3 constitute yokes 2A which are divided into a forward print section **2*a* and a rearward drive section 2*b*. The print section 2*a*, at the forward end of the yokes 2A has a printing head 7 affixed to it to move with it. Printing head 7 may be of any known variety. It is shown as comprising a plurality of printing wheels which have types 8 that carry figures, symbols and other indicia on their surfaces. The drive section 2*b* of the yokes are provided with driving members for intermittently rotating a feed wheel 11**.

The feed wheel 11 is rotatably secured on a main shaft 10 that is held between the pair of machine frames 9. Wheel 11 is driven by the drive section **2*b* on the yokes 2A** to feed a label strip L.

On the upper side of the machine body, there is a label strip holder 15 on the frames 9. The label strip L to be inserted and fed is held on the holder 15.

There are label strip guide pieces 16 and 17 which are formed on and supported on the frames 9 near the holder 15 of the label strip L. The surface of the lower label guide piece 16 extends from the opening in the rear portion of the holder 15 toward its front side with a downward inclination. An upper label guide piece 17 is attached in front of the lower end of the lower guide piece 16.

Figure 3:
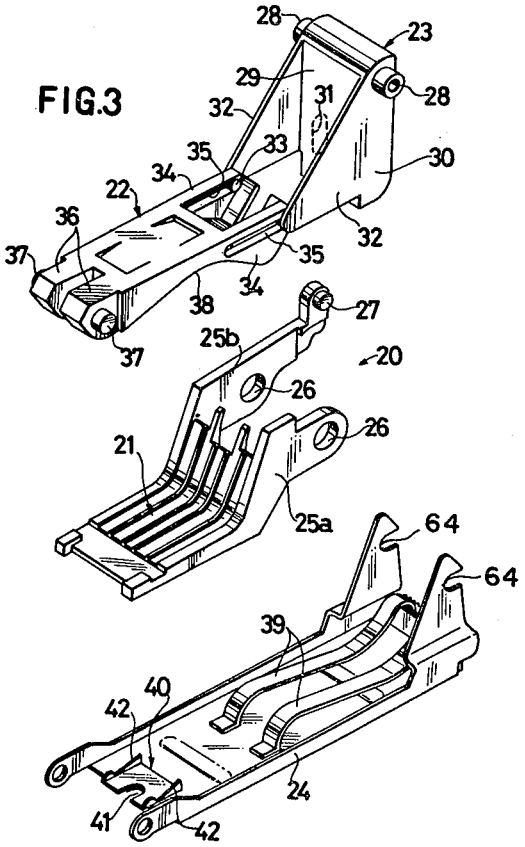
FIG. 3 is an exploded perspective view of the main parts of the label strip inserting device.

As shown in FIG. 3, the label inserting device 20 comprises the label imprinting platen 21, a label guide member 22 and an operating member 23 for directing the label strip L.

The platen 21 is integrally provided with a pair of opposed outside arms, including a short arm **25*a* and a long arm 25*b* at the rear end of the platen. Aligned shaft receiving holes 26 are respectively formed in both arms 25*a* and 25*b*. The main shaft 10 of the feed wheel 11 passes through the shaft receiving holes 26 for movably supporting the platen 21. At the rear tip end of the long arm 25*b*, there is a laterally extending pin 27 which is fitted into a slot 31 of the operating member 23**.

The operating member 23 has perpendicular side walls 30 which form a pair of forwardly extending elongated arms 32. The operating member 23 has a pair of outwardly projecting pins 28 formed on the upper part of its side walls 30, and the member 23 is pivotally secured to the machine frames 9 by the pins 28. When the operating member 23 is pivoted about the pins 28, the rectangular frame of a label guide surface 29 serves as a guiding surface for the label strip L. As described above, a slot 31 is formed in one of the side walls 30 of the rectangular frame forward of the surface 29 for receiving the pin 27 of the platen 21. On the inner side end portions of the pair of arms 32, pins 33 are formed. These are inserted into the elongated slits 35 of the label guide member 22 that is pivotally attached to the machine frames. The slits 35 are formed in a pair of arms 34 in the rear portion of the label guide member 22. Thus, the operating member 23 is turned about the pins 28 upon the movement of the other pins 33.

The label guide member 22 is pivotally attached to the machine frames 9 by a pair of pins 37 formed at the forward end portion of the member 22. The pins 37 are formed on another pair of arms 36 at the forward end of guide member 22. The member 22 also has a concave surface 38 which faces toward the feed wheel 11 and the platen 21, leaving a small space beneath member 22 through which may pass the label strip L.

The bottom cover 24 is positioned at the lower part of the machine frames 9. The cover is pivotally secured at its front end to a shaft 13 that is attached to the machine frames 9, so that the bottom cover 24 can be pivoted open about the shaft 13 in the clockwise direction in FIG. 1. The bottom cover 24 is fastened to the machine frames 9 by a locking device 14 (FIG. 1). This is comprised of rearwardly opening notches 64 at the rear of cover 24 and pin 14 extending through slots 66 in both machine frames 9. Pin 14 is movable forward and backward through slots 66 to engage or disengage the bottom cover. To the rear portion of the upper side of the bottom cover 24 are attached a pair of curved guide members 39 that are fitted to the lower peripheral surface of the feed wheel 11. A guide member 40 having a notch 41 and side walls 42 is attached to the front portion of the bottom cover 24, and the notch 41 opens toward the shaft 13 at the front side of the labeler.

Figure 4:
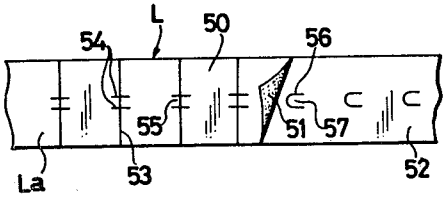
FIG. 4 is a plan view of a label strip used for the device of the present invention, in which the upper layer of the strip has been partly peeled off.

The label strip L is shown in FIG. 4 in plan view. The label material 50 and the backing strip 52 are assembled in layers to form the label strip L. The label material 50 has an adhesive layer 51 on its rear side. Label material 50 is pre-cut laterally at lines 53 at regular intervals so as to form a plurality of label pieces La. Two feed perforations 54 are formed at and extend across the middle portion of each pre-cut line 53. When the feed perforations 54 are engaged by a feed projection 12 on the feed wheel 11, the feed lips 55 between the perforations 54 are bent up and brought into operation.

At the portions of the backing strip 52 that are overlaid by the feed perforations 54, the U-shaped feed perforations 56 are formed. These become feed lips 57 when they are bent up in their engagement with the feed projections 12 of the feed wheel 11.

The operation of the label strip inserting device of the invention is now described. The device is operated from the closed position of FIG. 1 to the open position of FIG. 2. The bottom cover 24 drops and turns clockwise about the shaft 13 following release of the locking device 14 by moving pin 14 rearwardly. The platen 21 is then pivoted counterclockwise about the main shaft 10. In this pivoting operation, the pin 27 of the platen 21 slides within the slot 31 of the operating member 23 so that as platen 21 turns counterclockwise, the operating member 23 pivots clockwise about pivot 28. Eventually, the label guide surface 29 of the operating member 23 is aligned with the inclined surface of the label guide piece 16 and forms a continuous plane extending parallel to the upper label guide piece 17, so that a label strip passage 18 is formed.

In synchronism with the pivoting of the operating member 23, the pins 33 located on the member 23 are moved clockwise and they slide in the slots 35 of the label guide member 22. This lifts the guide member 22 and pivots it counterclockwise. Thus, a space 19 through which the label strip L may pass is formed between the upper peripheral surface of the feed wheel 11 and the curved surface 38 of the label guide member 22.

Next, the tip or leading end of the rolled label strip L carried by the holder 15 is pulled rearward and it is inserted into the opening 16' and is slid over the lower label guide piece 16. The label strip L is passed forward through the passage 18 formed between the upper label guide piece 17 and the guide surface 29 of the operating member 23. The label strip L is passed further through the space 19 between the label guide member 22 and the feed wheel 11. After this operation, the backing strip 52 of the label strip L is separated from the label material 50 on it (see FIG. 4). The backing strip 52 is folded in front of the front end of the platen 21 and the backing strip is pulled out toward the rear of the mchine body below the platen 21.

Upon the squeezing and releasing of the hand grip 1 and the hand lever 2, the feed projections 12 on the peripheral surface of the feed wheel 11 are brought into engagement with the feed perforations 56 of the backing strip 52 and with the feed perforations 54 of the label material 50 of the label strip L. The label strip L is advanced for the length of one label piece La by the engagement of projections 12 with the feed lips 55 and 57 of the label material 50 and backing strip 52.

At the forward tip end of the platen 21, the backing strip 52 is folded down and is then led to the space below the feed wheel 11. The platen 21 is turned clockwise from the open position into the closed position, and the bottom cover 24 is turned counter-clockwise and locked to the machine frame 9 with forward motion of the locking device pin 14. From the position of FIG. 2, the labeler has returned to the position of FIG. 1.

During each squeezing and releasing of the hand grip 1 and the hand lever 2, a label piece L*a*, peeled from the backing strip 52, is moved forward through the delivery opening 43 of the machine frame 9. When the grip 1 and the hand lever 2 are squeezed, the operation levers 2A are pivoted downwardly. This movement of the printing head 7 causes the inking device 44 to apply ink to the types 8. Further descent of the levers 2A causes the label strip L supported on the platen 21 to be printed by the inked types 8. When the hand lever 2 is released, the feed wheel 11 is turned counterclockwise through a predetermined angle by the drive section of the operation levers 2A under the action of the return spring 6 so that the label strip L is moved forward for the length of one label.

Figure 5:
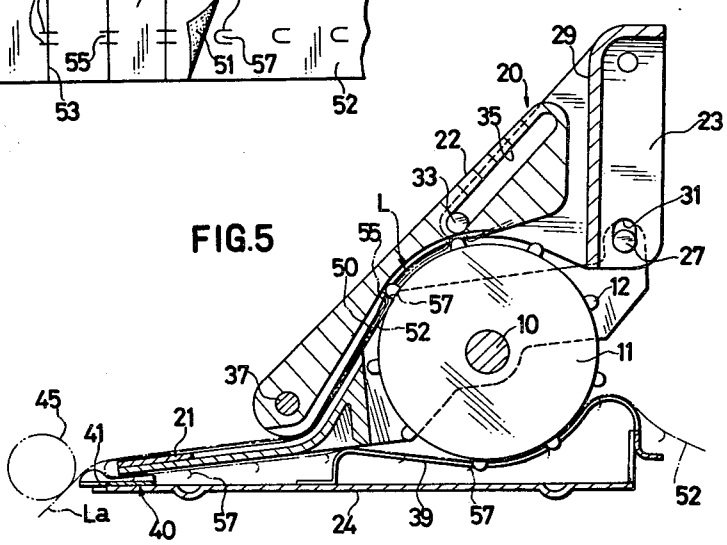
FIG. 5 is a fragmentary side elevational view showing the state of engagement between the label strip and a feed wheel.

As shown in FIG. 5, the backing strip 52 is bent back in a narrow space at the front end of the platen 21 which forms the loop 68. As a result of the bending of the backing strip 52, the feed lips 57 formed by the feed perforations 56 are stood up. However, the backing strip 52 can be smoothly passed through the inner front portion of the bottom cover 24 owing to the provision of the notch 41 of the guide member 40. The backing strip 52 further passes along the two curved guide members 39. Here, the feed perforations 56 of the backing strip 52 are again brought into engagement with the feed projections 12 of the feed wheel 11. Then the backing strip 52 is finally led out from the rear part of the machine body.

Meanwhile, the label piece L*a* that has been printed is peeled from the backing strip 52 and moved forward. The stiffness of the label piece L*a* prevents it from bending with the more flexible backing strip 52. The peeled label piece L*a* now projecting through the front of the label printing machine is applied firmly on the surface of an article by bringing the label piece L*a* into contact with the article and rubbing the surface of label piece L*a* with the label applying device 45.

According to the present invention, unfastening of the bottom cover enables the label guide member, which is fitted over the feed wheel, and the platen to be separated by means of the operating member that is interlocked with the opening action of the platen, thereby forming a space for passing the label strip. Further, such movement of the operating member brings the label guide surface of the operating member into line with the label guide piece that is positioned near the label strip holder to form a continuous surface. Therefore, a label strip can be inserted into the label printing machine body quite easily. In addition, even when the free end of the label strip is of a quite irregular shape, the label strip can be accurately inserted into the machine body without being bent aside.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. A label strip insertion device for a label printing machine, wherein said machine comprises:

a frame;

feed means attached to said frame for advancing a label strip along said frame;

an insertion device comprising:

a platen supported on said frame for motion between a lowered first inoperative position relatively further from said feed means and an upraised first operative position relatively nearer to said feed means; said platen having an upwardly facing surface over which a label strip can be fed and said upwardly facing surface being moved nearer to said feed means as said platen is moved to said first operative position;

a label guide member having a lower surface portion generally opposed to said feed means and beneath which the label strip can be fed; said guide member being supported on said frame for motion between an upraised second inoperative position relatively further from said feed means and a lowered second operative position relatively nearer to said feed means; said guide member being so placed that when it is in its second operative position, said lower surface portion thereof urges the label strip against said feed means for engagement thereby; said first and second inoperative positions being such that a widened space between said guide member and said feed means is created upon movement of said guide member and said platen to their respective said second and first inoperative positions;

an operating member supported on said frame for motion between a third position and a fourth position, and connected to both said platen and said guide member, such that said operating member transmits the motion of said platen to said guide member, whereby said platen and said guide member move simultaneously to their respective said first and second operative position when said operating member is in its said third position and to their respective said first and second inoperative position when said operating member is in its said fourth position;

said operating member having a label strip guide surface which, when said operating member in said fourth position, has a first orientation, which extends along a direction that directs a label strip into said widened space; said operating member label strip guide surface being so shaped and said guide member being so shaped that when said operating member is in said fourth position, a label strip fed past said operating member to said guide member is slightly deflected by said label strip guide surface before it is engaged by said guide member, whereby the label strip may be kept taut.

2. The label strip insertion device of claim 1, further comprising a cover attached to said frame and positioned at the side of said platen away from said guide member; said cover being securable to a closed position against said platen, with said platen at its said first operative position, for blocking motion of said platen to its said first inoperative position.

3. The label strip insertion device of claim 1, wherein said feed means comprises a rotatable feed wheel mounted to said frame for rotation and means for rotating said feed wheel; label strip engaging means on said feed wheel for engaging a label strip as said feed wheel rotates;

said label guide member being so placed and shaped that when it is in its said second operative position, said lower surface portion thereof urges the label strip against said feed wheel label strip engaging means for engagement thereby.

4. The label strip insertion device of claim 1, further comprising:

a first pivot mount on said frame; said platen being pivotally supported on said frame at said first pivot mount for pivoting thereabout between its said first operative and first inoperative positions;

a second pivot mount on said frame on which said guide member is pivotally supported; said first and said second pivot mounts being so positioned on said frame as to cause said platen and said guide member to create said widened space for the label strip as said platen and said guide member move to their respective said inoperative positions.

5. The label strip insertion device of claim 4, further comprising: a third pivot mount on said frame; said operating member being pivotally supported on said third pivot mount for pivoting thereabout; said platen and said guide member being pivotally connected to said operating member for pivoting with respect thereto as said operating member pivots.

6. The label strip insertion device of claim 1, wherein said lower surface portion of said guide member is generally opposed to and always spaced from said operating member label guide surface, and a label strip is always passed between said guide member lower surface portion and said label guide surface; with said lower surface portion and its said guide member in the said second inoperative position, said widened space being, in part, defined between said label guide surface and said lower surface portion.

7. The label strip insertion device of claim 6, further comprising label guide pieces supported by said frame and extending in said direction of extension of said widened space and positioned so that with said guide member in its said second inoperative position, a generally continuous, generally unidirectional pathway for a label strip to pass over is defined over said guide pieces and said operating member label guide surface.

8. A label strip insertion for a label printing machine, wherein said machine comprises:

a frame; feed means attached to said frame for advancing a label strip along said frame;

said frame having a forward end toward which the label strip is to be fed and having a rearward end opposite its said forward end;

a first pivot mount on said frame, a platen pivotally supported on said first pivot mount; said platen having an upwardly facing surface over which a label strip is fed; said platen upwardly facing surface being located forward in said frame of said first pivot mount; said platen being pivotable such that said surface thereof is pivotable between a first lowered inoperative position and a first upraised operative position;

a second pivot mount on said frame and located forwardly on said frame of said first pivot mount; a label guide member pivotally supported on said second pivot mount and extending generally rearwardly in said frame of said second pivot mount; said label guide member having a lower surface portion; said guide member being pivotable between an upraised second inoperative position and a lowered second operative position, such that a widened space is formed between said guide member and said feed means upon movement of said guide member and said platen to their respective said first and second inoperative positions;

a third pivot mount on said frame located rearwardly in said frame of said second pivot mount; an operating member pivotally supported at said third pivot mount for pivoting thereabout;

said platen being pivotally connected to said operating member at a fourth pivot mount remote from said third pivot mount;

said guide member being pivotally connected at a fifth pivot mount to said operating member and said fifth pivot mount being spaced from said third and said fourth pivot mounts;

said fourth pivot mount being generally rearward in said frame of said first and said fifth pivot mounts;

the connections between said operating member on the one hand and said platen and said guide member on the other hand being such that said operating member transmits the motion of said platen to said guide member, whereby said platen and said guide member move simultaneously to their respective said first and second operative and inoperative positions.

9. The label strip insertion device of claim 8, wherein said operating member includes a label guide surface which extends in a direction such that said guide surface is moved to a first orientation thereof which extends generally along the direction of extension of said widened space when said guide member is in said second inoperative position and which said guide surface extends out of the direction of extension of said widened space and out of the path of a label strip when said guide member is in said second inoperative position;

said lower surface portion of said guide member being generally opposed to and always spaced from said label guide surface, and a label strip is always passed between said lower surface portion and said label guide surface; with said lower surface portion and its said guide member in the said second inoperative position, said widened space being, in part, defined between said label guide surface and said lower surface portion.

10. The label strip insertion device of claim 9, further comprising label guide pieces supported by said frame and extending in said direction of extension of said widened space and positioned so that with said guide member in its said second inoperative position, a generally continuous, generally unidirectional pathway for a label strip to pass over is defined over said guide pieces and said operating member label guide surface.

11. The label strip insertion device of claim 10, wherein said feed means comprises a rotatable feed wheel mounted to said frame for rotation and means for rotating said feed wheel; label strip engaging means on said feed wheel for engaging a label strip as said feed wheel rotates; said feed wheel being located rearwardly in said frame of said second pivot; said label guide member extending rearwardly in said frame past said feed wheel;

said label guide member being so placed and shaped that when it is in its said second operative position, said lower surface portion thereof urges the label strip against said feed wheel label strip engaging means for engagement thereby.

* * * * *

UNITED STATES PATENT AND TRADEMARK OFFICE

CERTIFICATE OF CORRECTION

PATENT NO. : 4,176,603

DATED : December 4, 1979

INVENTOR(S) : Yo Sato

It is certified that error appears in the above-identified patent and that said Letters Patent is hereby corrected as shown below:

Column 6, line 26, change "fourth" to --third--

Signed and Sealed this

Twenty-ninth Day of March, 1988

*Attest:*

DONALD J. QUIGG

*Attesting Officer*

*Commissioner of Patents and Trademarks*